US008113154B2

(12) United States Patent
Syler

(10) Patent No.: US 8,113,154 B2
(45) Date of Patent: Feb. 14, 2012

(54) TRANSITION ELEMENT FOR A PASSAGE IN A WATER HEATER

(75) Inventor: Rodney Ray Syler, Franklin, TN (US)

(73) Assignee: AOS Holding Company, Wilmington, DE (US)

( * ) Notice: Subject to any disclaimer, the term of this patent is extended or adjusted under 35 U.S.C. 154(b) by 665 days.

(21) Appl. No.: 12/258,130

(22) Filed: Oct. 24, 2008

(65) Prior Publication Data

US 2010/0101505 A1 Apr. 29, 2010

(51) Int. Cl.
*F22B 7/18* (2006.01)

(52) U.S. Cl. ..... 122/160; 122/155.1

(58) Field of Classification Search ..... 122/160, 122/161, 162, 155.1, 155.2, 155.4, 181
See application file for complete search history.

(56) References Cited

U.S. PATENT DOCUMENTS

| | | | | | |
|---|---|---|---|---|---|
| 516,061 | A * | 3/1894 | Norton | 122/161 |
| 2,800,125 | A * | 7/1957 | Westman | 126/106 |
| 3,707,142 | A | 12/1972 | Kobayashi | |
| 4,262,608 | A * | 4/1981 | Jackson | 110/162 |
| 4,338,888 | A | 7/1982 | Gerstmann et al. | |
| 4,909,190 | A | 3/1990 | Finch | |
| 4,940,042 | A * | 7/1990 | Moore et al. | 122/18.2 |
| 5,020,512 | A * | 6/1991 | Vago et al. | 122/18.2 |
| 5,411,013 | A * | 5/1995 | Kazen | 126/307 R |
| 5,666,942 | A * | 9/1997 | Kazen | 126/307 R |
| 5,924,390 | A | 7/1999 | Bock | |
| 6,647,977 | B2 | 11/2003 | Lesage | |
| 7,013,841 | B1 * | 3/2006 | Boros et al. | 122/19.2 |

* cited by examiner

*Primary Examiner* — Gregory A Wilson
(74) *Attorney, Agent, or Firm* — Michael Best & Friedrich LLP

(57) ABSTRACT

A water heater. The water heater includes a water tank adapted to contain water to be heated, a combustion chamber positioned proximate the water tank, a combustor positioned in the combustion chamber and operable to create products of combustion, a passage extending upwardly from the combustion chamber and through the water tank, the passage having an upper portion comprising an inner tube and an outer tube and a lower portion comprising an inner tube and an outer tube, and a transition element positioned in the passage and configured to direct supply air from the outer tube of the upper portion to the inner tube of the lower portion and deliver hot products of combustion from the outer tube of the lower portion to the inner tube of the upper portion, the transition element maintaining separation of the supply air and the products of combustion.

18 Claims, 9 Drawing Sheets

TRANSITION ELEMENT FOR A PASSAGE IN A WATER HEATER

BACKGROUND

The present invention relates to water heaters, and more particularly to a transition element for a passage in a water heater.

SUMMARY

In one embodiment, the invention provides a water heater comprising a water tank adapted to contain water to be heated, a combustion chamber positioned proximate the water tank, a combustor positioned in the combustion chamber and operable to create products of combustion, a passage extending upwardly from the combustion chamber and through the water tank, the passage having an upper portion comprising an inner tube and an outer tube and a lower portion comprising an inner tube and an outer tube, and a transition element positioned in the passage and configured to direct a flow of supply air from the outer tube of the upper portion to the inner tube of the lower portion and deliver a flow of hot products of combustion from the outer tube of the lower portion to the inner tube of the upper portion, the transition element maintaining separation of the flow of supply air and the flow of products of combustion.

In another embodiment, the invention provides a water heater comprising a water tank adapted to contain water to be heated, a combustion chamber positioned proximate the water tank, a combustor positioned in the combustion chamber and operable to create products of combustion, a duct, a coaxial flue extending upwardly from the combustion chamber and through the water tank, the coaxial flue including an inner tube and an outer tube, and a transition element positioned between and communicating with the coaxial flue and the duct, the transition element configured to direct a flow of supply air to the inner tube of the coaxial flue and deliver a flow of products of combustion from the outer tube of the coaxial flue to the duct, the transition element maintaining separation of the flow of supply air and the flow of products of combustion.

In another embodiment, the invention provides a transition element positionable within a passage of a water heater, the passage extending upwardly through a water tank from a combustion chamber and having an upper portion having an inner tube and an outer tube and a lower portion having an inner tube and an outer tube. The transition element includes a first frustoconical section having a base and an opposite narrow end, the narrow end communicable with the inner tube of the upper portion. The first section also includes a first opening. The transition element further includes a second frustoconical section having a base and an opposite narrow end, the narrow end of the second section communicable with the inner tube of the lower portion, and the base of the second section communicable with the base of the first section. The second section also includes a second opening on a side opposite the first opening. The transition element further includes a dividing wall that extends inside the frustoconical sections and that divides the interior of the transition element into a first conduit extending between the second opening and the narrow end of the first frustoconical section and a second conduit extending between the first opening and the narrow end of the second frustoconical section. The first conduit is configured to deliver a flow of products of combustion from the outer tube of the lower portion to the inner tube of the upper portion, and the second conduit is configured to deliver a flow of supply air from the outer tube of the upper portion to the inner tube of the lower portion.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
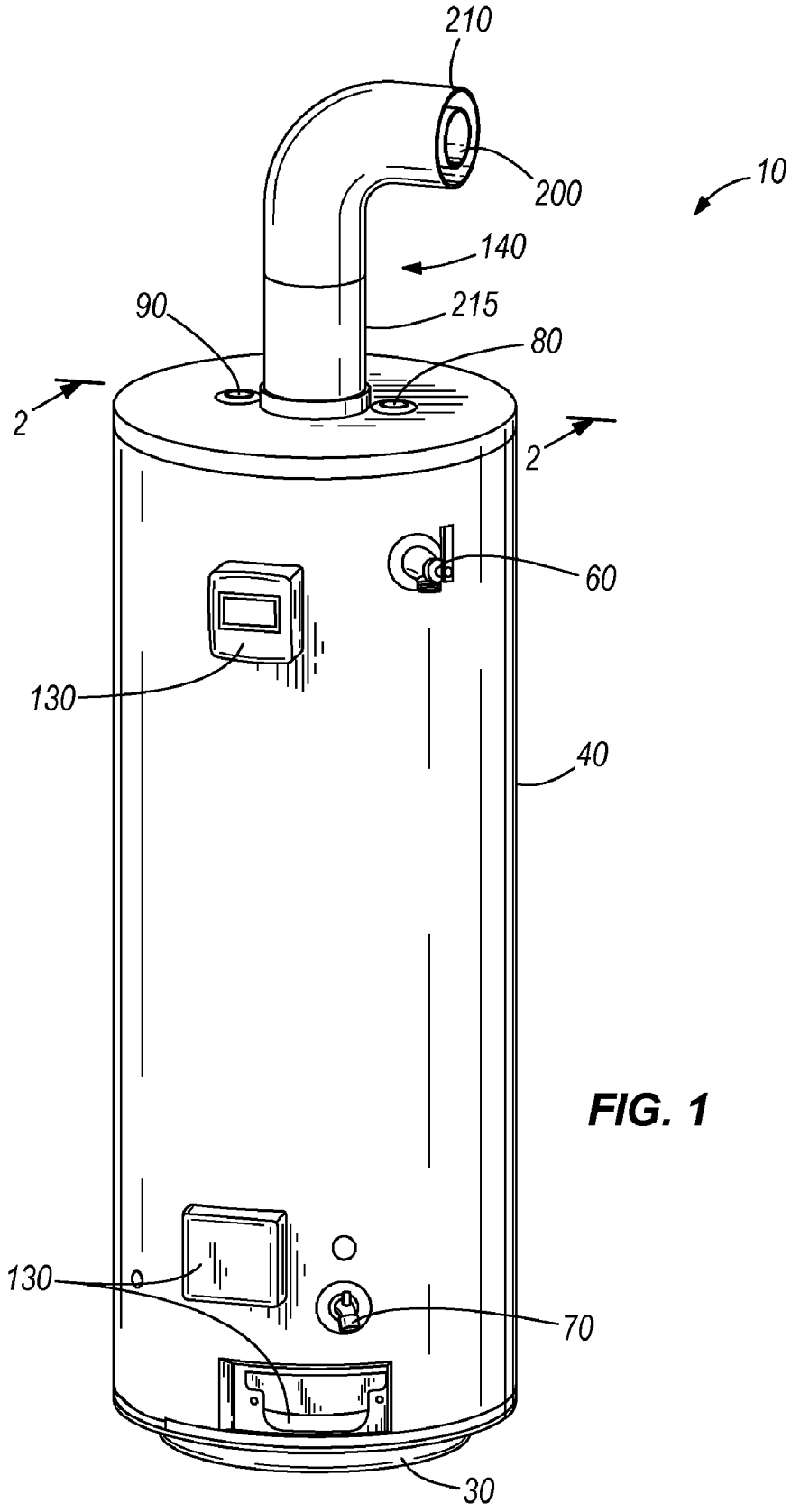
FIG. 1 is a water heater system embodying some aspects of the invention.
Figure 2:
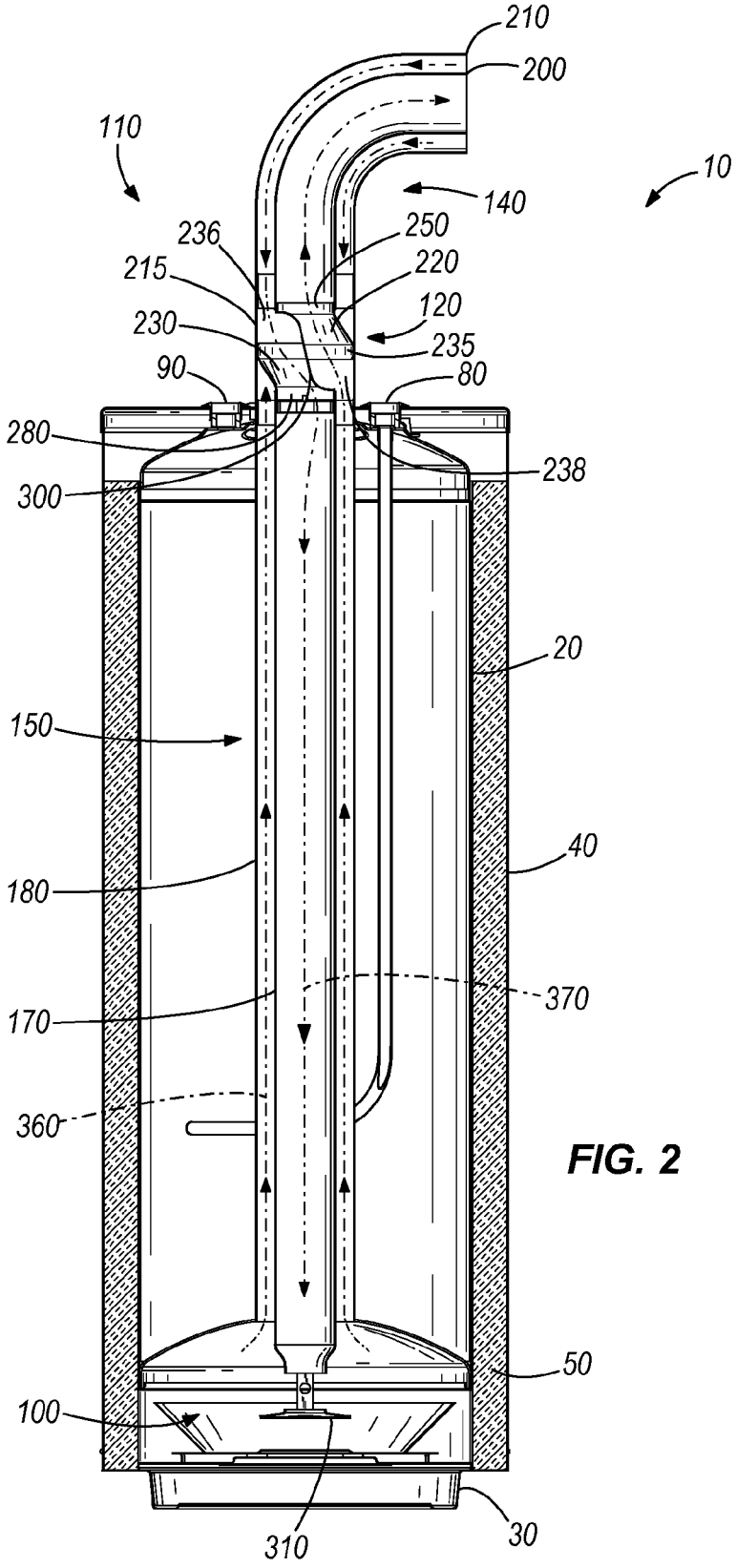
FIG. 2 is a cross-sectional view of the water heater system of FIG. 1 taken along line 2-2 of FIG. 1 and showing a passage and a transition element according to the invention.

FIGS. 1 and 2 illustrate a water heater 10 embodying the invention. The water heater 10 comprises a water tank 20 for containing water to be heated, a base pan 30 supporting the water tank 20, an outer jacket 40 surrounding the water tank 20, insulation 50 between the tank 20 and the jacket 40, a temperature and pressure relief valve 60, a drain valve 70, a cold water input 80, a hot water output 90, and a combustion chamber 100 positioned below the tank 20. The water heater 10 further includes a passage 110 communicating with the combustion chamber 100 and extending substantially vertically through the water tank 20 and above the water tank 20, and a transition element 120 positioned within the passage 110. The water heater 10 also includes a control system 130 which may include temperature sensors, water sensors, a current sensor on the power circuit, a switch box or module, and an operator panel. Other constructions of the water heater can include different or additional control sensors, and it should be understood that not all of the components for the control system are required for all constructions. It is to be understood that the water heater 10 described herein is only for exemplary purposes. Other constructions of the water heater also fall within the scope of the invention.

Figure 3:
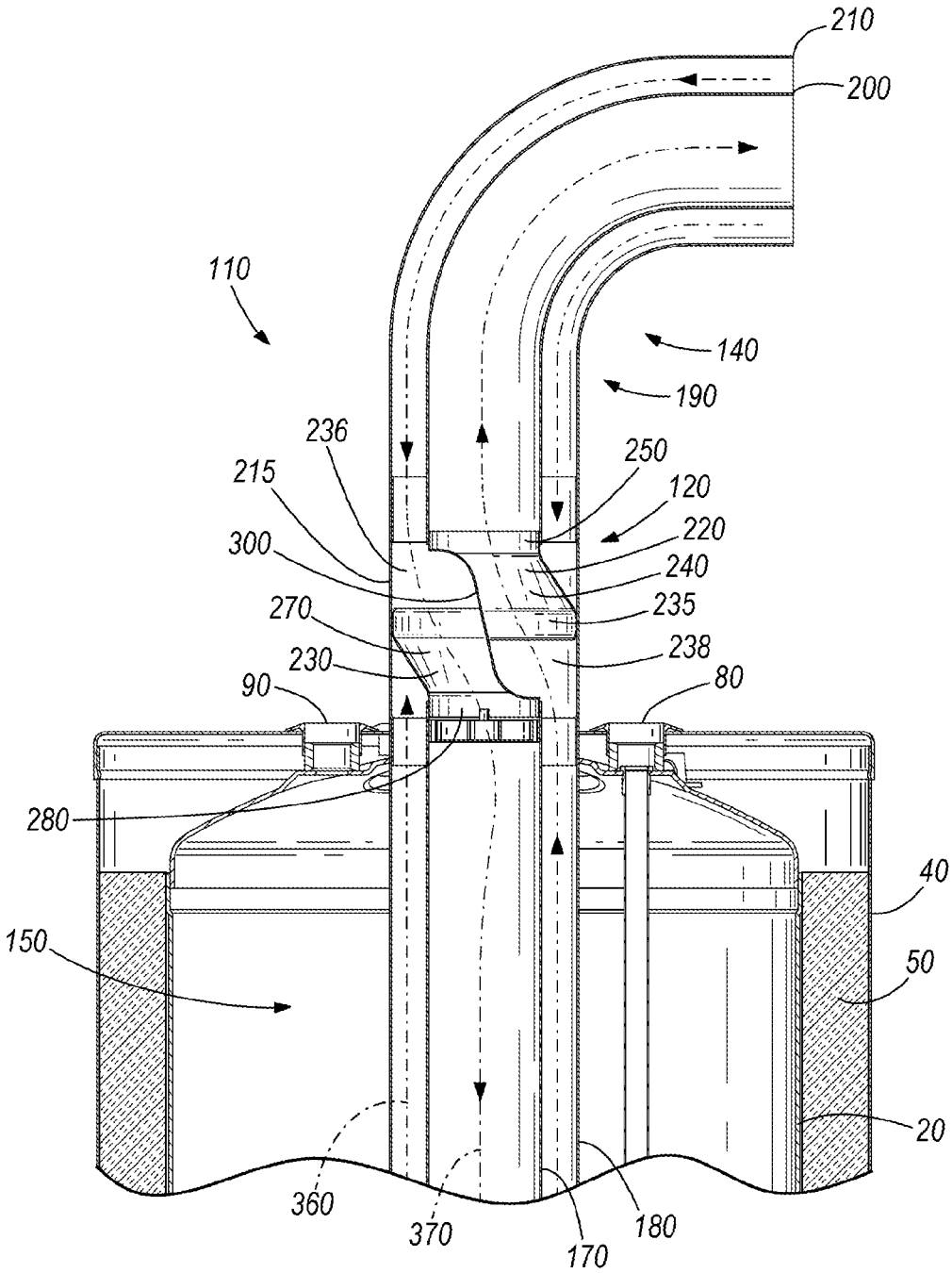
FIG. 3 is a detailed view of the passage and transition element of FIG. 2.

As shown in FIGS. 2 and 3, the passage 110 is a coaxial passage that includes an upper portion 140 and a lower portion 150. The passage is formed of galvanized steel; however, in other embodiments, the passage may be formed of other material. The lower portion 150 extends substantially vertically from the combustion chamber 100 through the water tank 20. As illustrated, the lower portion 150 is a coaxial flue having an inner tube 170 and an outer tube 180. The inner tube 170 is configured to direct supply air for combustion from the upper portion 140 of the passage 110 to the combustion chamber 100. The outer tube 180 surrounds the inner tube 170 and is configured to deliver hot products of combustion from the combustion chamber 100 to the upper portion 140 of the passage 110. In some embodiments, the inner tube has a 4-inch diameter and the outer tube has a 6-inch diameter. In still other embodiments, the inner tube has a 3-inch diameter and the outer tube has a 5-inch diameter. Other diameters are within the scope of the invention.

The upper portion 140 of the passage 110 is an L-shaped duct 190 that extends upward from the water tank 20. As shown, the duct 140 has an inner tube or exhaust duct 200 and an outer tube 210. The inner tube 200 conducts exhaust gasses or products of combustion, and the outer tube 210 conducts supply air. However, in other embodiments, the duct 190 can include only the tube or exhaust duct 200 for conducting exhaust gasses. Supply air can be drawn from the room air surrounding the water heater. The passage 110 also includes a transition section 215 connecting the outer tube 210 and the outer tube 180. In alternative embodiments, the tubes 210 and 180 can be directly connected.

Figure 4:
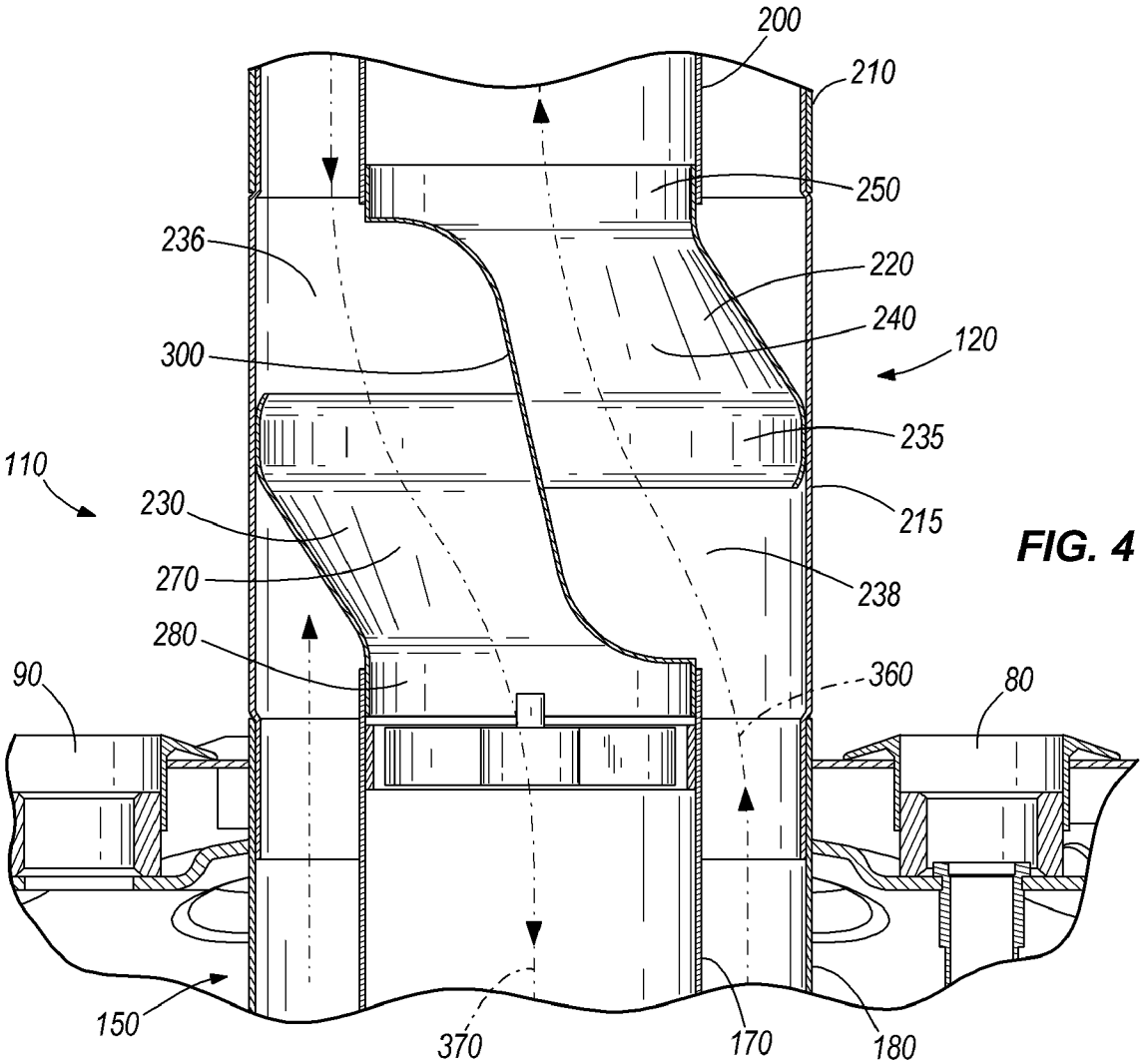
FIG. 4 is a detailed view of the transition element of FIG. 2.
Figure 5:
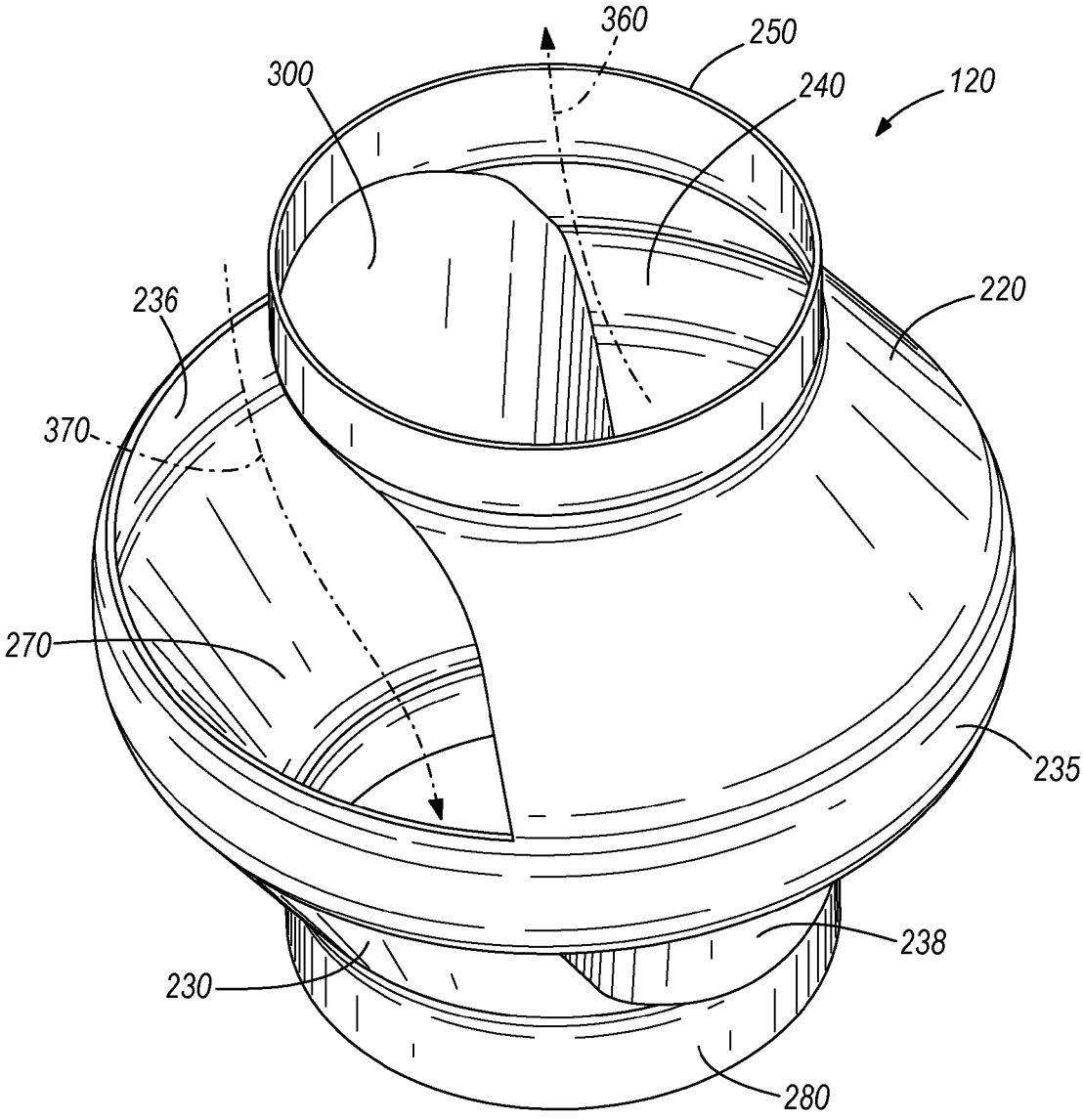
FIG. 5 is a perspective view of the transition element of FIG. 2.
Figure 6:
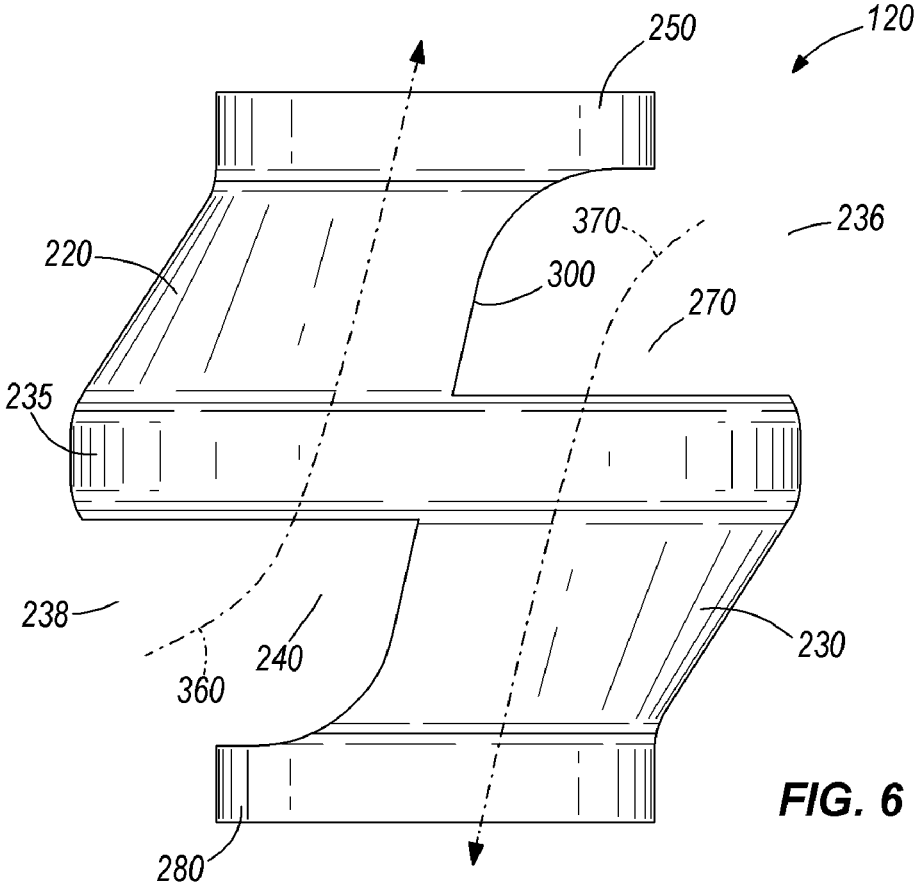
FIG. 6 is a side view of the transition element of FIG. 2.
Figure 7:
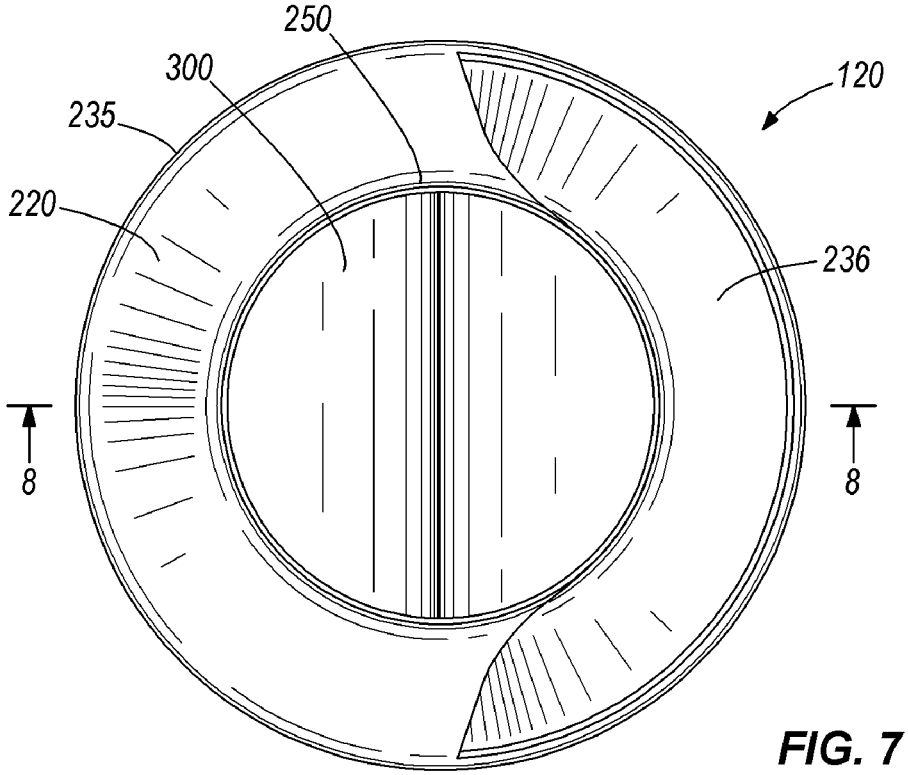
FIG. 7 is a top view of the transition element of FIG. 2.
Figure 8:
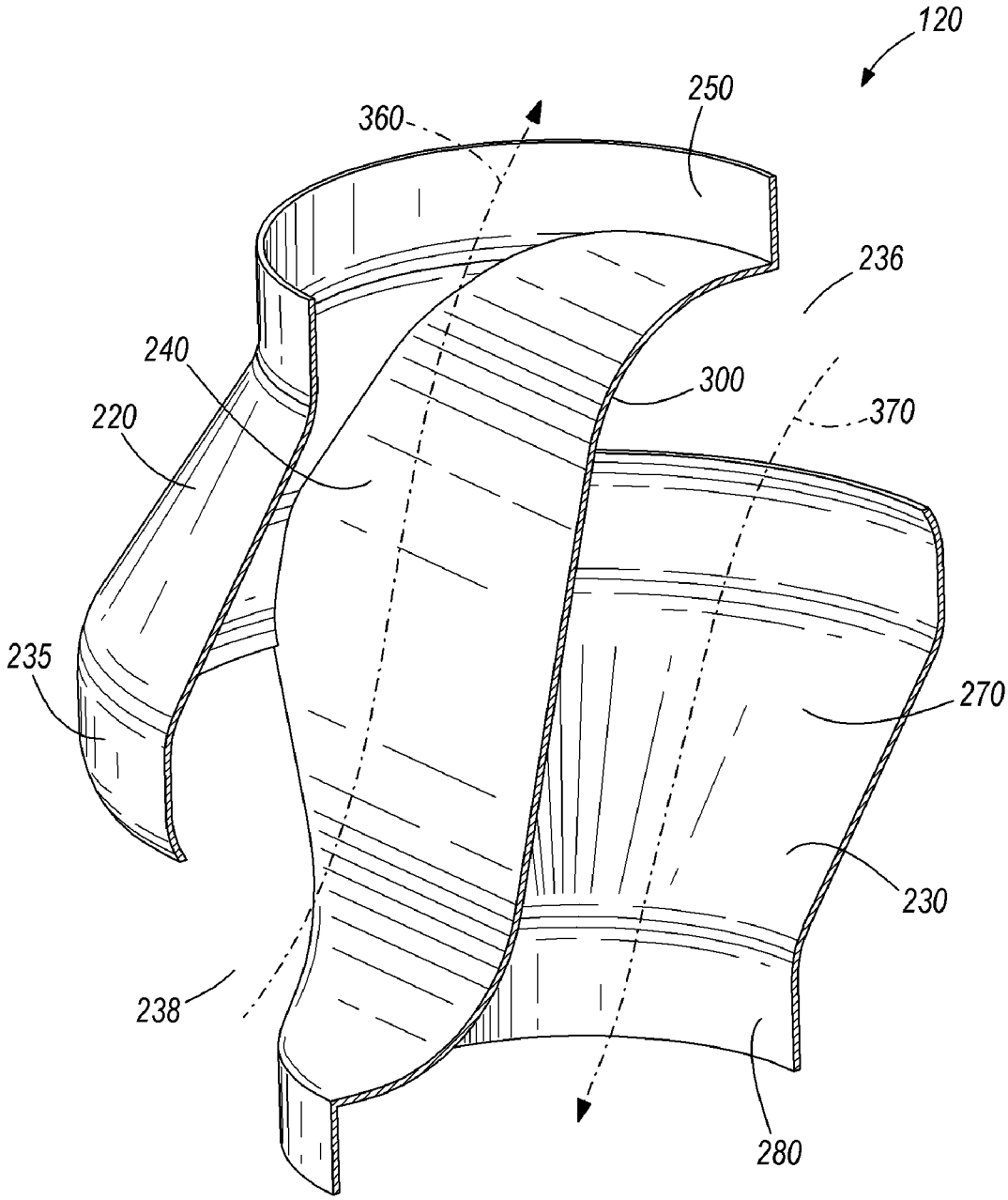
FIG. 8 is a cross-sectional view of the transition element of FIG. 2 taken along line 8-8 of FIG. 7.

As shown in FIGS. 2-4, the transition element 120 is positioned within the passage 110 and communicates between the coaxial flue 150 and the duct 190. In the illustrated construction, the transition element 120 is located in the transition section 215. In alternative embodiments, in which the outer tubes 210 and 180 are directly connected, the transition element 120 can be located inside either of tubes 210 and 180. The transition element 120 is configured to direct supply air from the outer tube 210 of the duct 190 to the inner tube 170 of the coaxial flue 150 and deliver hot products of combustion from the outer tube 180 of the coaxial flue 150 to the inner tube 200 of the duct 190. The transition element 120 is further configured to maintain separation of the supply air and the products of combustion, such that the supply air and the products of combustion do not mix within the passage 110.

As shown in FIGS. 2-8, the transition element 120 includes a first or upper frustoconical section 220 having a narrow end and an opposite base or wide end, and a second or lower frustoconical section 230 having a narrow end and an opposite base or wide end. The transition element 120 also includes a generally cylindrical middle section 235 connecting the base of the upper section 220 to the base of the lower section 230. The middle section 235 fits tightly inside the transition section 215, so that gasses do not flow around the transition element 120. The upper frustoconical section 220 has therein, on one side thereof, an opening 236. The lower frustoconical section 230 has therein, on the side opposite the opening 236, an opening 238. The transition element 120 also includes a generally cylindrical first or upper conduit section 250 that extends from the narrow end of the upper frustoconical section 220 and that extends into and sealingly communicates with the lower end of the inner tube 200. The transition element 120 also includes a generally cylindrical second or lower conduit section 280 that extends from the narrow end of the lower frustoconical section 230 and that extends into and sealingly communicates with the upper end of the inner tube 170.

The transition element 120 also includes a dividing wall 300 that extends inside the sections 220, 235 and 230. The dividing wall divides the interior of the transition element 120 into first and second conduits 240 and 270. The first conduit 240 communicates between the opening 238 and the upper conduit section 250, or the narrow end of the section 220, and thereby between the outer tube 180 of the coaxial flue 150 and the inner tube 200 of the duct 190. The second conduit 270 communicates between the opening 236 and the lower conduit section 280, or the narrow end of the section 230, and thereby between the outer tube 210 of the duct 190 and the inner tube 170 of the coaxial flue 150. Gasses or air flowing within the first conduit 240 and the second conduit 270 are separated by the wall 300 and do not mix. As best shown in FIG. 4, the dividing wall 300 is generally S-shaped in vertical cross section.

In other embodiments, the transition element may have other shapes or configurations configured to direct the supply air and the products of combustion through the passage. The transition element may be various sizes and shapes, such that the size and shape of the transition element is determined by the size of the passage. In other embodiments, the upper frustoconical section and the lower frustoconical section may comprise two separate elements.

The transition element 120 may be stamped, cast, or molded from polymeric materials suitable for the temperatures and flue products present in the passage of the water heater application. In some embodiments, the transition element may be integrally formed with the passage. However, in other embodiments, the transition element is removably positioned within the passage. Furthermore, since the transition element is positioned within the passage, the transition element does not add additional height to the water heater. The transition element allows for the water heater system to have better combustion qualities, such as lower nitrogen oxide emission and high efficiency as compared to a water heater construction without the transition element since the transition element allows for use of the coaxial flue construction.

Figure 9:
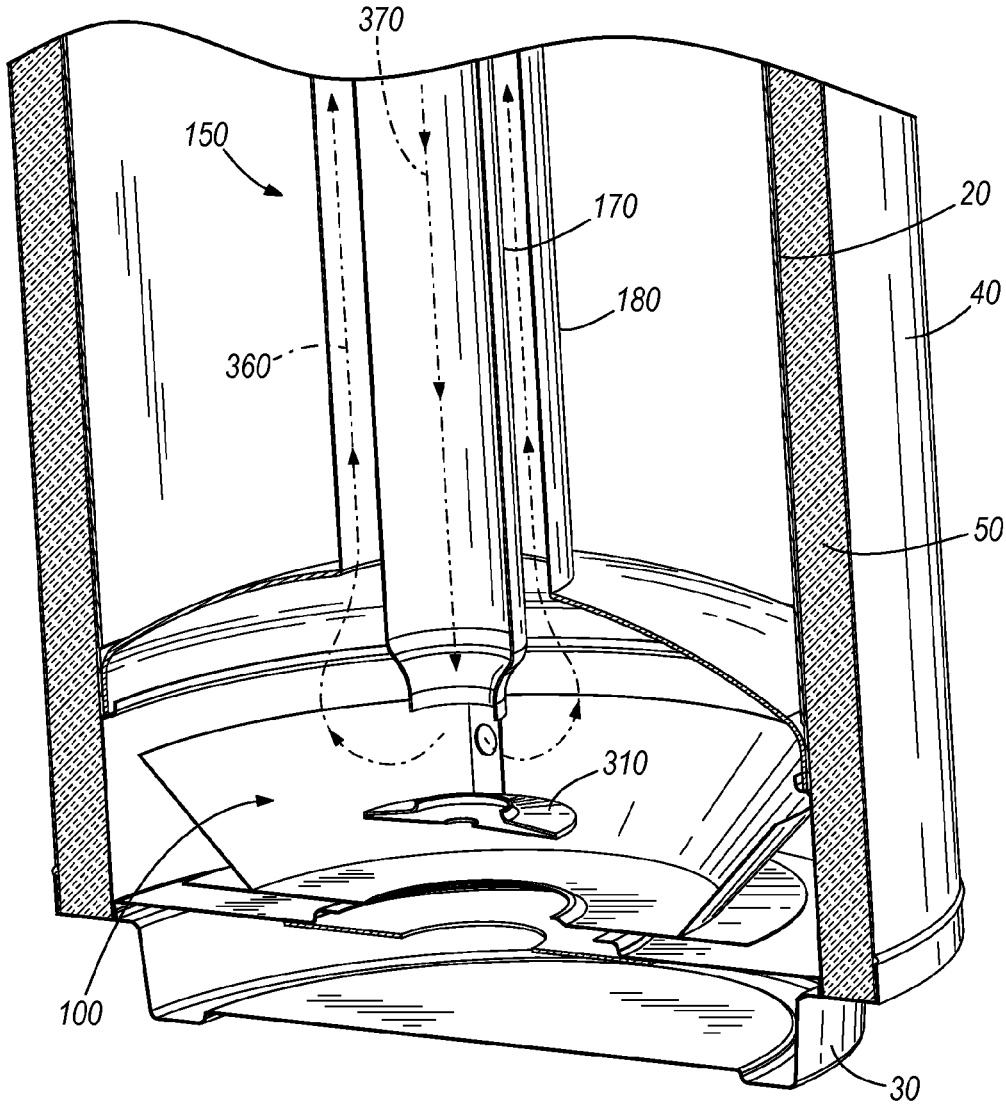
FIG. 9 is a perspective view of a combustion chamber of FIG. 2.
Figure 10:
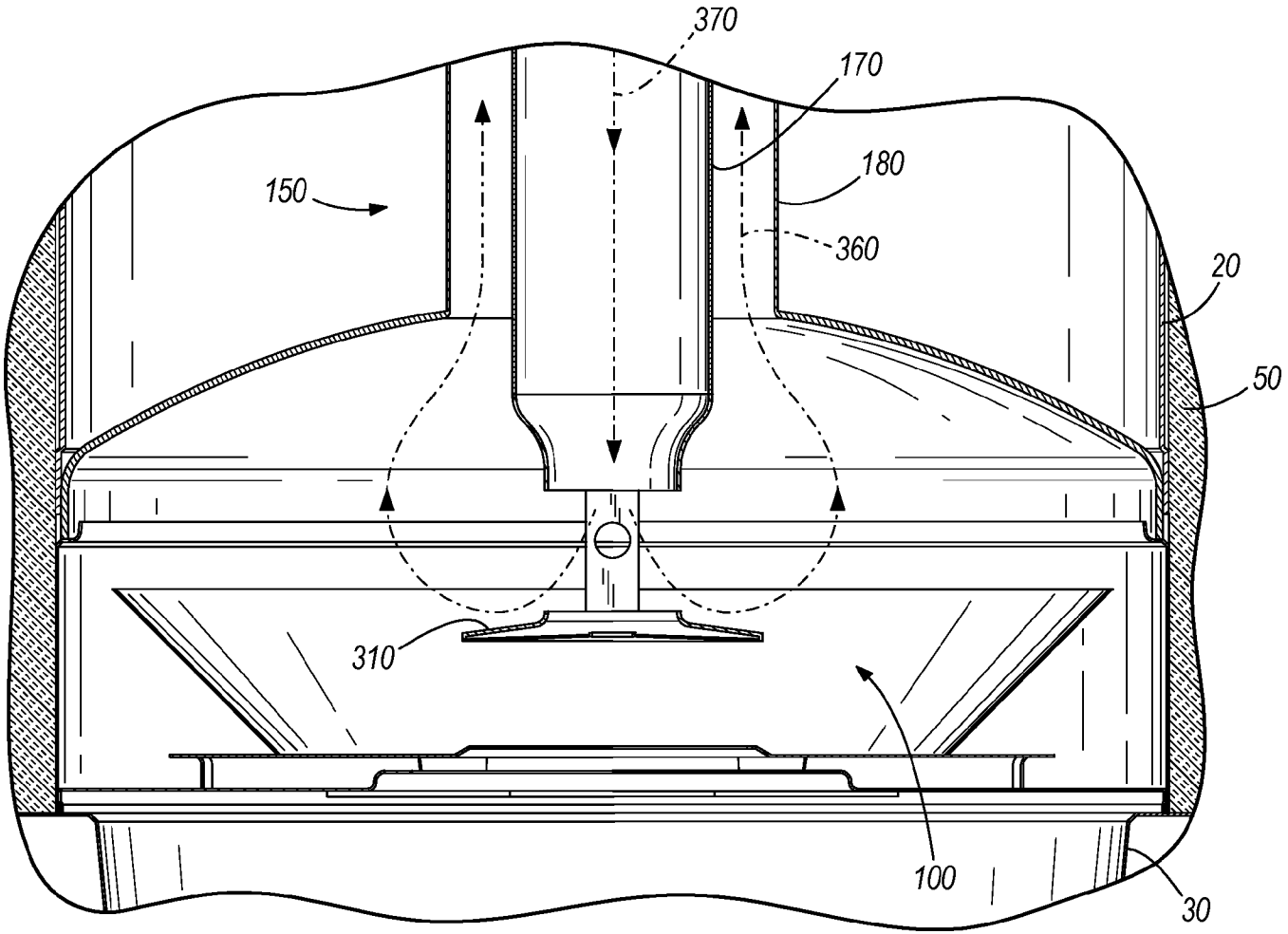
FIG. 10 is a front view of the combustion chamber of FIG. 2.

As shown in FIGS. 2 and 9-10, the combustion chamber 100 communicates with the coaxial flue 150 of the passage 110. Fuel is supplied to a combustor or burner 310 positioned in the combustion chamber 100 through a fuel line having a gas valve. The illustrated burner 310 is inverted relative to a conventional burner, because the supply air is coming from above the burner 310. In other embodiments, the supply air could be directed below the burner so that the burner need not be inverted. For example, the inner tube 170 could be extended downward and through the middle of the burner. In some embodiments, the burner may be shielded for protection from excessive heat. Additional or excessive heat may be used to increase the velocity of the fuel supply or gas stream through an orifice to the burner. Manifold pressure increases as a result of the excessive heat and the subsequent increases in velocity of the gas stream to the burner.

In operation, the burner 310 burns fuel supplied by the fuel line along with supply air drawn into the combustion chamber 100 through the inner tube 170 of the coaxial flue 150. The burner 310 creates products of combustion that rise through the outer tube 180 of the coaxial flue 150 and heat the water in the water tank by conduction through the wall of the outer tube 180. The flow of products of combustion is driven by natural convection, but may alternatively be driven by a blower unit communicating with the flue 150. The products of combustion formed in the combustion chamber 100 flow upwardly through the outer tube 180 as shown by arrows 360 (FIG. 2). The products of combustion then flow through the first conduit 240 of the transition element 120 to the inner tube 200 of the duct 190 for venting from the water heater 10.

Similarly, supply air flows downwardly to the combustion chamber 100 as shown by arrows 370. The supply air flows first through the outer tube 210, through the second conduit 270 of the transition element 120, and then through the inner tube 170 of the coaxial flue 150. As the supply air is delivered to the combustion chamber 100, the supply air in the inner tube 170 is in heat exchange relation with the hot gasses in the outer tube 180, such that the hot gasses transfer heat to the cool supply air. Pre-heating of the supply air increases the rate of combustion in the combustion chamber.

The construction of the coaxial flue increases the surface area of the flue for increased heat exchange between the products of combustion and the water in the water tank. Because the inner tube is inside the outer tube, the outer tube has a greater diameter and thus a greater outside surface area for heat exchange with the water in the tank.

Various features and advantages of the invention are set forth in the following claims.

What is claimed is:

1. A water heater comprising:

a water tank adapted to contain water to be heated;

a combustion chamber positioned proximate the water tank;

a combustor positioned in the combustion chamber and operable to create products of combustion;

a passage extending upwardly from the combustion chamber and through the water tank, the passage having an upper portion comprising an inner tube and an outer tube and a lower portion comprising an inner tube and an outer tube; and a transition element positioned in the passage and configured to direct a flow of supply air from the outer tube of the upper portion to the inner tube of the lower portion and deliver a flow of hot products of combustion from the outer tube of the lower portion to the inner tube of the upper portion, the transition element maintaining separation of the flow of supply air and the flow of products of combustion.

2. The water heater of claim 1 wherein the transition element is integrally formed with the passage.

3. The water heater of claim 1 wherein the transition element further comprises a first frustoconical section having a base and an opposite narrow end, the narrow end communicating with the inner tube of the upper portion, the first section also including a first opening, the transition element further comprising a second frustoconical section having a base and an opposite narrow end, the narrow end of the second section communicating with the inner tube of the lower portion, and the base of the second section communicating with the base of the first section, the second section also including a second opening on a side opposite the first opening, and the transition element further comprising a dividing wall that extends inside the frustoconical sections and that divides the interior of the transition element into a first conduit extending between the second opening and the narrow end of the first frustoconical section and a second conduit extending between the first opening and the narrow end of the second frustoconical section, such that the first conduit delivers the flow of products of combustion from the outer tube of the lower portion to the inner tube of the upper portion, and the second conduit delivers a flow of supply air from the outer tube of the upper portion to the inner tube of the lower portion.

4. The water heater of claim 3 wherein the transition element further comprises a cylindrical section between the base of the first frustoconical section and the base of the second frustoconical section, the cylindrical section fitting tightly inside the passage so that gasses do not flow around the transition element.

5. The water heater of claim 3 wherein the transition element further comprises an upper conduit section that communicates between the narrow end of the first frustoconical section and the inner tube of the upper portion, and a lower conduit section that communicates between the narrow end of the second frustoconical section and the inner tube of the lower portion.

6. The water heater of claim 3 wherein the dividing wall is generally S-shaped in vertical cross section.

7. The water heater of claim 1 wherein the supply air in the inner tube of the lower portion is in heat exchange relation with the products of combustion in the outer tube of the lower portion, and wherein the products of combustion in the outer tube of the lower portion are in heat exchange relation with the water in the water tank.

8. A water heater comprising:

a water tank adapted to contain water to be heated;

a combustion chamber positioned proximate the water tank;

a combustor positioned in the combustion chamber and operable to create products of combustion;

a duct;

a coaxial flue extending upwardly from the combustion chamber and through the water tank, the coaxial flue including an inner tube and an outer tube; and a transition element positioned between and communicating with the coaxial flue and the duct, the transition element configured to direct a flow of supply air to the inner tube of the coaxial flue and deliver a flow of products of combustion from the outer tube of the coaxial flue to the duct, the transition element maintaining separation of the flow of supply air and the flow of products of combustion.

9. The water heater of claim 8 wherein the transition element further comprises a first frustoconical section having a base and an opposite narrow end, the narrow end communicating with the duct, the first section also including a first opening, the transition element further comprising a second frustoconical section having a base and an opposite narrow end, the narrow end of the second section communicating with the inner tube of the coaxial flue, and the base of the second section communicating with the base of the first section, the second section also including a second opening on a side opposite the first opening, and the transition element further comprising a dividing wall that extends inside the frustoconical sections and that divides the interior of the transition element into a first conduit extending between the second opening and the narrow end of the first frustoconical section and a second conduit extending between the first opening and the narrow end of the second frustoconical section, such that the first conduit delivers the flow of products of combustion from the outer tube of the coaxial flue to the duct, and the second conduit delivers a flow of supply air to the inner tube of the coaxial flue.

10. The water heater of claim 9 wherein the duct further comprises an inner tube and an outer tube, such that the first conduit delivers the flow of products of combustion from the outer tube of the coaxial flue to the inner tube of the duct, and the second conduit directs a flow of supply air from the outer tube of the duct to the inner tube of the coaxial flue.

11. The water heater of claim 9 wherein the transition element further comprises a cylindrical section between the base of first frustoconical section and the base of the second frustoconical section, the cylindrical section fitting tightly inside the passage so that gasses do not flow around the transition element.

12. The water heater of claim 9 wherein the dividing wall is generally S-shaped in vertical cross section.

13. The water heater of claim 9 wherein the transition element further comprises an upper conduit section that communicates between the narrow end of the first frustoconical section and the duct, and a lower conduit section that communicates between the narrow end of the second frustoconical section and the inner tube of the coaxial flue.

14. The water heater of claim 8 wherein the supply air in the inner tube of the coaxial flue is in heat exchange relation with the products of combustion in the outer tube of the coaxial flue, and wherein the products of combustion in the outer tube of the coaxial flue are in heat exchange relation with the water in the water tank.

15. A transition element positionable within a passage of a water heater, the passage extending upwardly through a water tank from a combustion chamber and having an upper portion having an inner tube and an outer tube and a lower portion having an inner tube and an outer tube, the transition element comprising:

a first frustoconical section having a base and an opposite narrow end, the narrow end communicable with the inner tube of the upper portion, the first section also including a first opening;

a second frustoconical section having a base and an opposite narrow end, the narrow end of the second section communicable with the inner tube of the lower portion, and the base of the second section communicable with the base of the first section, the second section also including a second opening on a side opposite the first opening; and a dividing wall that extends inside the frustoconical sections and that divides the interior of the transition element into a first conduit extending between the second opening and the narrow end of the first frustoconical section and a second conduit extending between the first opening and the narrow end of the second frustoconical section;

wherein the first conduit is configured to deliver a flow of products of combustion from the outer tube of the lower portion to the inner tube of the upper portion, and the second conduit is configured to deliver a flow of supply air from the outer tube of the upper portion to the inner tube of the lower portion.

16. The transition element of claim 15, further comprising an upper conduit section that communicates between the narrow end of the first frustoconical section and the inner tube of the upper portion, and a lower conduit section that communicates between the narrow end of the second frustoconical section and the inner tube of the lower portion.

17. The transition element of claim 15, further comprising a cylindrical section between the base of the first frustoconical section and the base of the second frustoconical section, the cylindrical section fitting tightly inside the passage so that gasses do not flow around the transition element.

18. The transition element of claim 15 wherein the dividing wall is generally S-shaped in vertical cross section.

* * * * *